US010920448B2

(12) United States Patent
Rogers

(10) Patent No.: US 10,920,448 B2
(45) Date of Patent: Feb. 16, 2021

(54) FENCING TOOL

(71) Applicant: Rusty Lane Rogers, Morton, MS (US)

(72) Inventor: Rusty Lane Rogers, Morton, MS (US)

( * ) Notice: Subject to any disclaimer, the term of this patent is extended or adjusted under 35 U.S.C. 154(b) by 124 days.

(21) Appl. No.: 15/956,948

(22) Filed: Apr. 19, 2018

(65) Prior Publication Data

US 2019/0003204 A1 Jan. 3, 2019

Related U.S. Application Data

(60) Provisional application No. 62/525,809, filed on Jun. 28, 2017.

(51) Int. Cl.
*E04H 17/26* (2006.01)

(52) U.S. Cl.
CPC ..... *E04H 17/268* (2013.01); *E04H 17/261* (2013.01); *E04H 17/266* (2013.01)

(58) Field of Classification Search
CPC ... E04H 17/268; E04H 17/261; E04H 17/266; E04H 17/26; E04H 17/02; B25B 13/48; B25B 13/481; B25B 33/00; F16B 35/02
USPC ..... 81/488, 484, 486, 124.2; 411/419
See application file for complete search history.

(56) References Cited

U.S. PATENT DOCUMENTS

| | | | | | |
|---|---|---|---|---|---|
| 2,804,887 | A * | 9/1957 | Reck | H01R 43/0335 | 140/123 |
| 3,765,242 | A * | 10/1973 | Bailleu | G01K 1/14 | 136/230 |
| 3,805,854 | A * | 4/1974 | Self | B21F 7/00 | 140/117 |
| 6,520,487 | B2 * | 2/2003 | Crichton | F16G 11/12 | 256/40 |
| 6,908,271 | B2 * | 6/2005 | Breslin | F16B 13/126 | 411/271 |
| 7,520,491 | B1 * | 4/2009 | Post | E04H 17/268 | 256/1 |
| 2005/0155201 | A1 * | 7/2005 | Laxson | E04H 17/10 | 29/7.1 |

OTHER PUBLICATIONS

Klein Tools, Grizzly Bar, Aug. 5, 2016 (Year: 2016).*
Wikipedia, Unified Thread Standard, Dec. 11, 2016, ASME (Year: 2016).*

* cited by examiner

*Primary Examiner* — Orlando E Aviles
*Assistant Examiner* — Robert F Neibaur
(74) *Attorney, Agent, or Firm* — Michael C. Williams; Bradley Arant Boult Cummings LLP

(57) ABSTRACT

The present disclosure provides a fencing tool having a first and second end separated by a shaft, the second end further comprising an opening drilled therein and extending partially the length of the shaft and a plurality of exterior grooves on its exterior.

18 Claims, 5 Drawing Sheets

FENCING TOOL

CROSS REFERENCE TO OTHER APPLICATIONS

This application claims priority to, and the benefit of, pending U.S. Provisional Patent Application No. 62/525,809 filed Jun. 28, 2017.

FIELD OF THE DISCLOSURE

The present disclosure pertains to a tool for attaching and/or removing t-post clips to/from a t-post. More specifically, the present disclosure pertains to a tool that can be used to attach and/or remove a t-post clip to/from a t-post which allows wire to be secured to the t-post.

BACKGROUND

The use of fencing by farmers and ranchers changed the face of America. In particular, in the West, the use of barbed wire to define grazing boundaries essentially changed the landscape in drastic ways as land owners no longer were able to free graze their animals, such as cows, on the open range. Fence posts are a necessary part of every fence and originally fence posts were all wooden posts typically 4-6 inches in diameter to which the fencing materials could be attached, often by using metal "staples". Using all wood posts on large fencing projects however is both time consuming and expensive, so the metal t-post was developed. Typically, several metal t-posts are placed between wooden posts which provides a more economical fence as the t-posts are easier to place into the ground and are cheaper than the wooden posts.

One issue with t-posts is securing the fencing material (such as barbed wire or smooth wire) to the t-post. The most common method is the use of metal wire clips which engage the wire and wrap around the t-post. One such clip is shown in FIG. 1. A clip will need to be installed on each strand of wire on each t-post, thus with a large project, a number of clips are necessary and installing the clips is both time consuming and difficult due to fatigue of the installer. The present disclosure provides a tool that makes the installation of wire clips quicker and easier.

BRIEF DESCRIPTION OF THE DRAWINGS

To further illustrate the advantages and features of the present disclosure, a more particular description of the invention will be rendered by reference to specific embodiments thereof which are illustrated in the appended drawings. It is appreciated that these drawings are not to be considered limiting in scope. The invention will be described and explained with additional specificity and detail through the use of the accompanying drawings in which.

SUMMARY OF THE DISCLOSURE

In a first aspect, the present disclosure provides a fencing tool having a first and second end separated by a shaft, the second end further comprising an opening drilled therein and extending partially the length of the shaft and a plurality of exterior grooves on its exterior.

In a second aspect, the present disclosure provides a fencing tool with a first and second end separated by a shaft, the second end further comprising: an opening drilled therein and extending partially the length of the shaft and a plurality of grooves on its exterior, said grooves being configured to provide a friction fitment against a fence wire.

In a third aspect, the present disclosure provides a fencing tool with a first and second end separated by a shaft, the second end further comprising an opening drilled therein and extending partially the length of the shaft and wherein the shaft comprises an annular wall surrounding the opening and the opening has a diameter and wherein the thickness of the annular wall is greater than the diameter of the opening.

DETAILED DESCRIPTION

Figure 1:
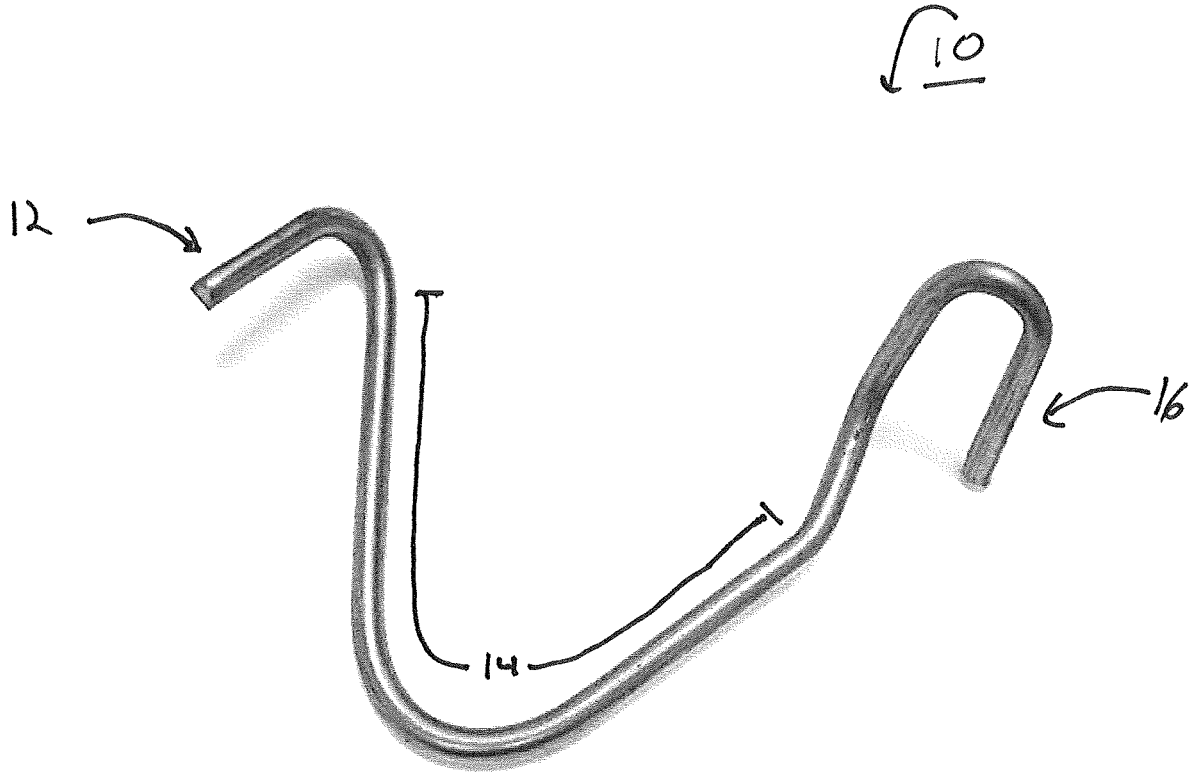
Fig. 1 PRIOR ART
FIG. 1 shows one embodiment of prior art wire clip.
Figure 2:
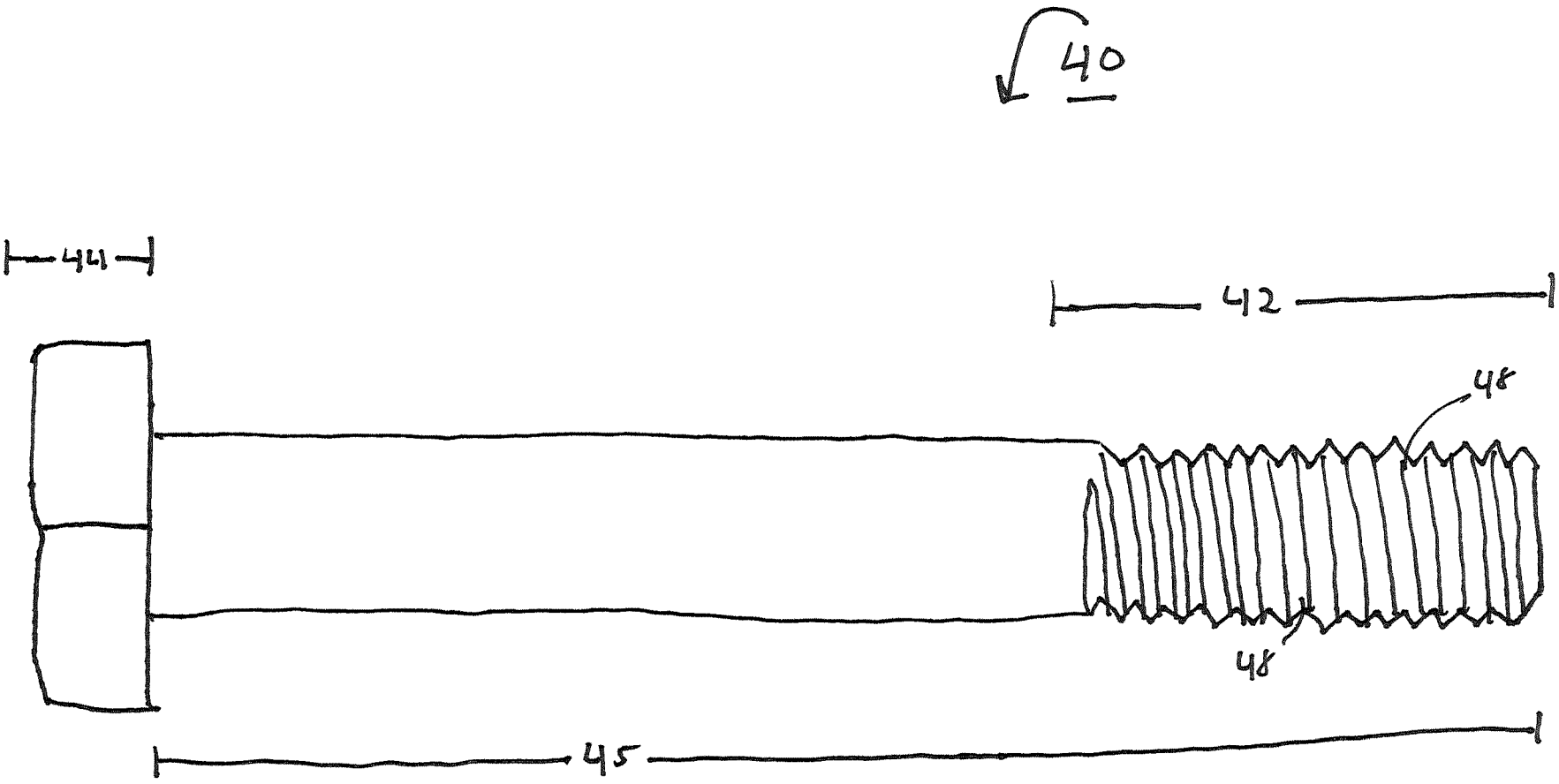
FIG. 2 shows a side view of one embodiment of the fencing tool.
Figure 3:
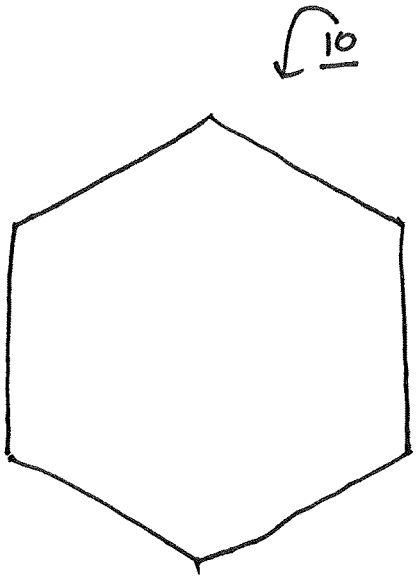
FIG. 3 shows a top view of one embodiment of the fencing tool.

Now referring to FIG. 1, a prior art clip 10 is shown. The clip 10 is often made of wire and shaped so that it has a first end 12 which engages the fence wire 30 on one side of the t-post 20, a t-post engagement area 14 which is placed around the t-post 20 and a second end 16 which engages the fence wire 30 on the opposite side of the t-post 20. The second end 16 is then wound or wrapped around the fence wire 30 thereby securing the clip to the wire on both sides of the t-post 20 and using friction, secures the clip 10 to the t-post.

Now referring to FIGS. 2-6, a fencing tool 40 is provided that allows an installer to quickly and easily install a clip 10 around a t-post 20. The fencing tool 40 includes a clip engagement end 42 and a handle end 44 separate by a shaft 45.

Figure 4:
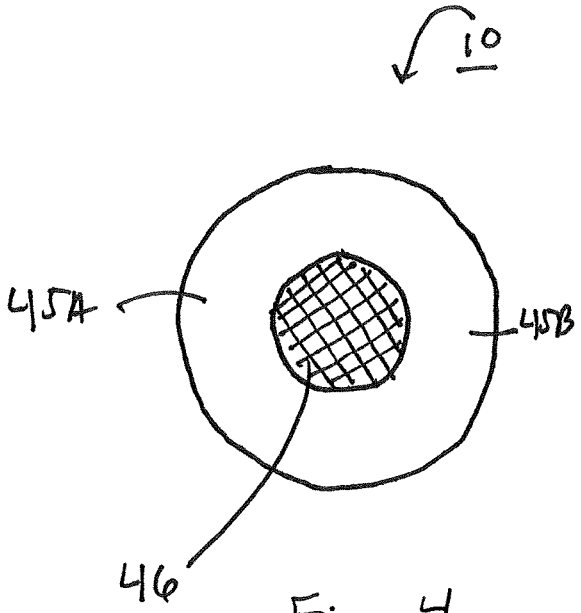
FIG. 4 shows a bottom view of one embodiment of the fencing tool.
Figure 5:
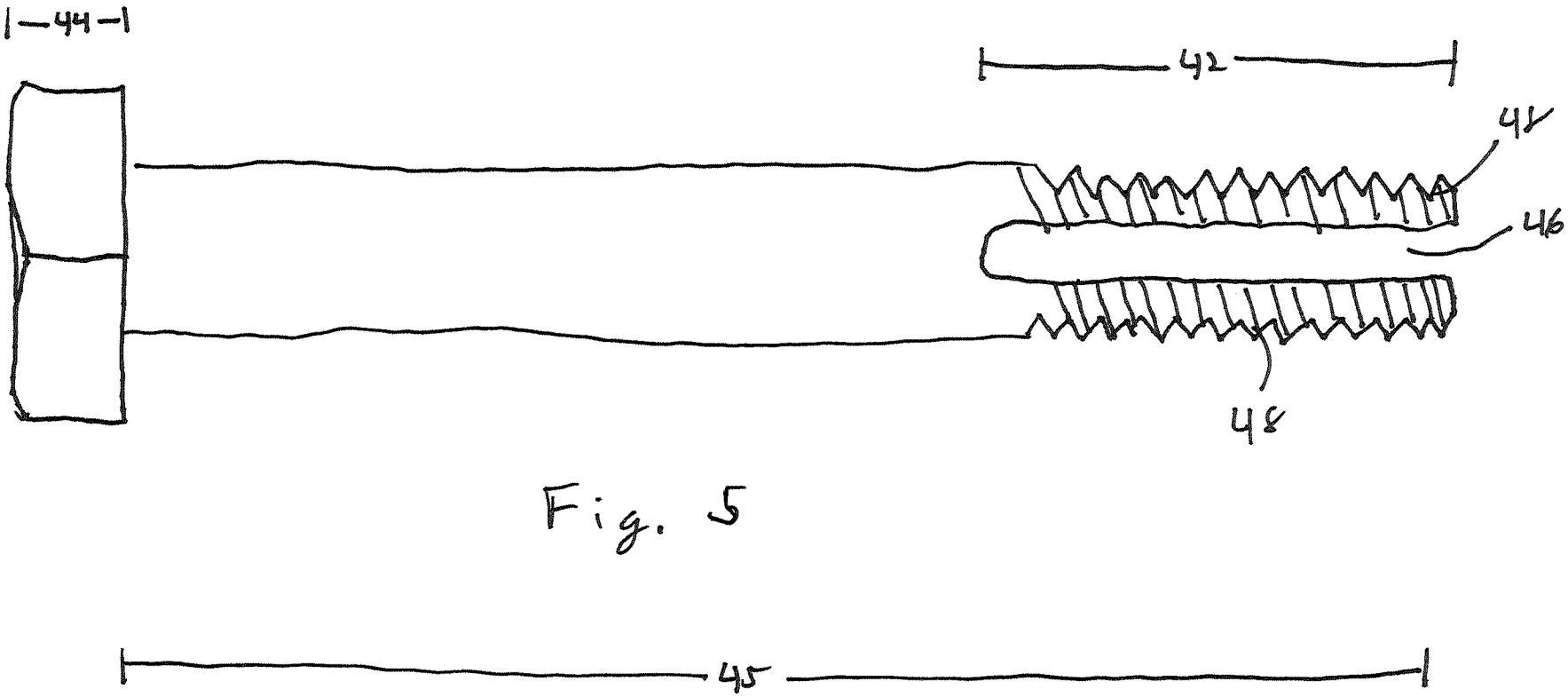
FIG. 5 shows a cut away view of one embodiment of the fencing tool.

The clip engagement end 42 has an opening 46 in its distal end. This opening 46 is adapted and configured to receive the first and second ends 12, 16 of the clip 10. In one embodiment, the opening 46 is approximately ⅛ inch in diameter while the shaft 45 has an outer diameter of approximately ½ inch. Thus, as shown in FIG. 4 there are two (2) outer portions (45A and 45B) of the shaft 48 that form an annular wall remaining after the hole is drilled which are thicker than the opening's 46 diameter, i.e., the remaining walls are thicker than the opening's 46 diameter. While the disclosure and scope of the invention is not to be limited to such a configuration, it is believed that the configuration offers certain advantages in that the fencing tool 40 is not as susceptible to bending or deformation during use. Other diameters of openings 46 and shafts 45 should be considered within the scope of this disclosure. The opening 46 is machined or drilled into the distal end of the clip engagement end 42. In various embodiments, the opening 46 is approximately 0.1-4.0 inches in depth, 0.5 to 3.0 inches in depth or 1.0 to 2.0 inches in depth. In one preferred embodiment, the opening 46 is approximately 1.4-1.5 inches in depth. The opening 46 does not extend the entire length of the shaft 45 or the fencing tool 40 but rather only extends axially a portion of the length of the shaft 45 or the fencing tool 40.

Figure 6:
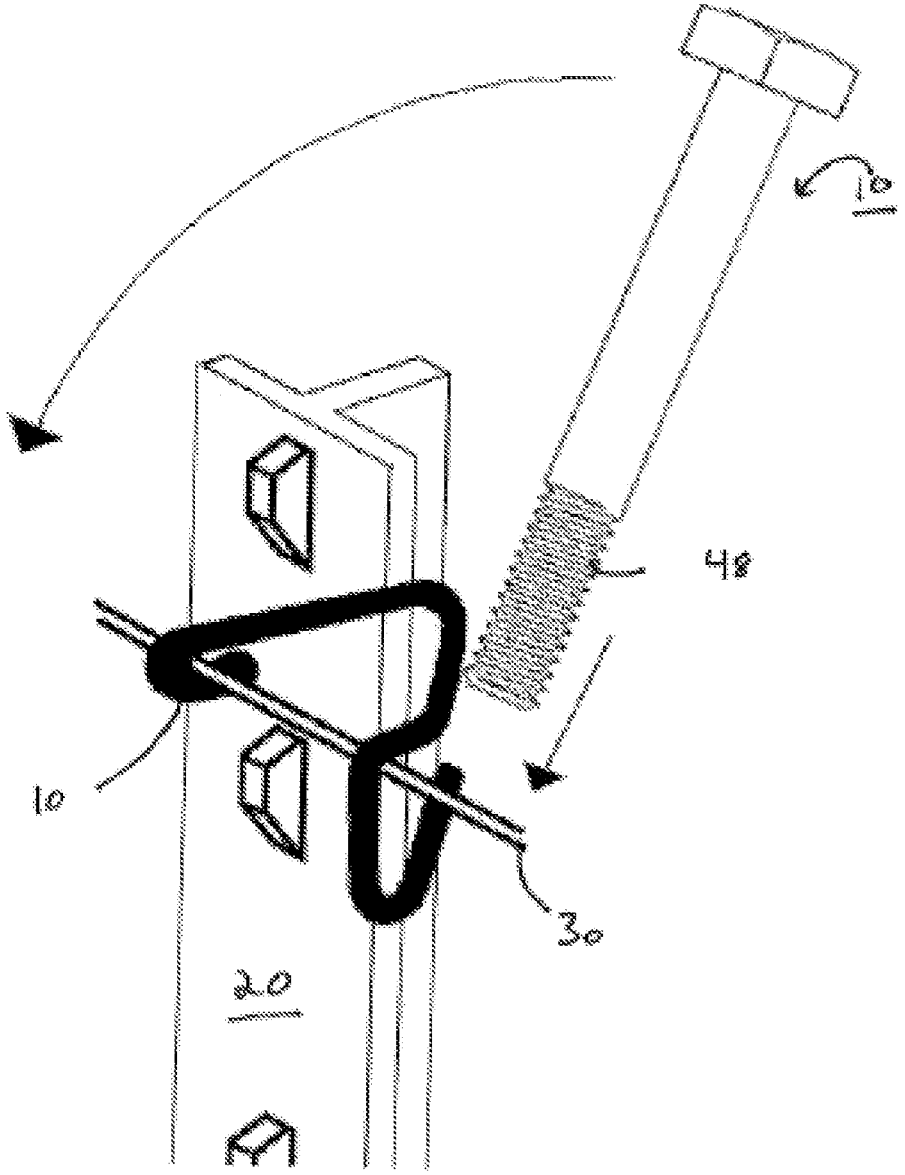
FIG. 6 shows one embodiment of the use of the fencing tool.

The clip engagement end 42 also has a plurality of grooves 48 on its outer surface. The grooves 48 provide a friction fit against the fencing wire 30 that is being secured by the clip 10. In particular, as shown in FIG. 6 once the ends of the clip 10 are placed within the opening 46, a user may lay the fencing tool 40 against the fencing wire 30 which then fits within a groove 48. As the fencing tool 40 is rotated to wrap the clip 10 around the fencing wire 30, the fitment of the fence wire 30 in a groove 48 prevents the fencing tool from slipping. Thus the grooves 48 provide an important safety function as the user is less at risk of having the fencing tool 40 slip during use and cause the user to slam or jam their hand into either the t-post or a barb if barbed wire is being installed. In one embodiment, the grooves 48 extend 0.1-4.0 inches in length up the shaft 45 from the distal end, 0.5 to 3.0 inches in length or 1.0 to 2.0 inches in length. In one preferred embodiment, the grooves 48 extend approximately 1.3-1.5 inches in length. Additionally, the fencing tool 40 may have approximately 5-20 grooves per linear inch or preferably between 10 and 15 grooves 48 per linear inch to provide the necessary spacing and size to receive the fence wire 30 and grip it securely.

Opposite the clip engagement end 42, the fencing tool 10 has a handle end 44. The handle end 44 is adapted and configured to provide a convenient place to securely grip the fencing tool 40 during use. In various embodiments, the handle end 44 may have a hex-shaped head or potentially a flattened portion for ease of grasping.

The fencing tool 10 may be made out of a number of materials. It is believed however that a hardened metal, such as quenched and tempered steel is desirable as it provides the strength and durability needed to allow the fencing tool 40 to provide years of service. Of course, additives may be added to the steel as desired to provide desirable properties. In one embodiment, the fencing tool 40 is constructed from grade 8 steel which is a medium carbon alloy steel that has been quenched and tempered during forging. Typically, the mechanical properties of grade 8 steel include a proof load of approximately 120,000 pounds per square inch (PSI), a minimum yield strength of about 130,000 PSI, a Core Rockwell Hardness (HRC) of C33-39 and a minimum tensile strength of about 150,000 PSI.

The dimensions of the fencing tool 40 may be varied for various purposes. The inventor has found that a length of approximately 6.0 to 7.0 inches is both convenient in that it is easy to carry and manipulate but provides enough leverage to allow a user to wrap the clip 10 around the fence wire 30 without undue force. Other lengths ranging from 3.0 inches to 12.00 inches should be considered within the scope of this disclosure. Additionally the diameter of the shaft 45 may also be varied between 0.1 and 1.0 inches and in one embodiment the shaft 45 has an outer diameter of about 0.5 inches.

Additionally, the tool may be painted a highly visible color, such as bright yellow, red, blue, green, pink or orange to aid in locating the tool in a tool box or if it dropped in tall grass such as in a pasture.

The fencing tool 40 is simple and easy to use as shown in FIG. 6. First, after the t-post is driven into the ground and the fence wire 30 is brought near the t-post, the clip 10 is positioned so that its first end 12 is wrapped around the fence wire 30 on one side of the post. Then the clip 10 is manipulated so that it is around the t-post and the second end 16 is positioned over the fence wire 30. Then, the fencing tool 40 is positioned over the clip 10 so that the end of the second end 16 of the clip 10 is inserted into the opening 46. The fencing tool 40 is then laid against the fence wire 30 so that the grooves 48 contact the fence wire 30 and the fencing tool 40 is rotated to tighten the second end 16 around the fence wire 30. The length and overall design of the fencing tool 40 allow the clip 10 to be wrapped very securely around the fence wire 30. The process then may be repeated with the first end 12 of the clip 10 to secure it as well.

Although particular embodiments of the present disclosure have been described, it is not intended that such references be construed as limitations upon the scope of this disclosure except as set forth in the claims.

I claim:

1. A fencing tool comprising:

a first end and a second end separated by a shaft, wherein the first end, the shaft and the second end are coaxial;

wherein the diameter of the shaft and the outermost diameter of the second end are the same size;

wherein the outermost width of the first end has a larger size than the diameter of the shaft, wherein the outermost width is measured in a direction parallel to the diameter of the shaft;

the second end further comprising:

a. an opening drilled through the second end and partially extending through the length of the shaft and b. a plurality of grooves, wherein the plurality of grooves surround the exterior of only the second end, and the plurality of grooves extend the length of the second end.

2. The fencing tool of claim 1 wherein the shaft comprises an annular wall surrounding the opening and the opening has a diameter and wherein the thickness of the annular wall is greater than the diameter of the opening.

3. The fencing tool of claim 1 wherein the opening has a depth of at least 1.00 inch, but less than 3.00 inches.

4. The fencing tool of claim 2 where the opening has a depth of at least 1.00 inch, but less than 3.00 inches.

5. The fencing tool of claim 1 wherein the exterior grooves extend at least 1.00 inch along the second end.

6. The fencing tool of claim 2 wherein the exterior grooves extend at least 1.00 inch along the second end.

7. The fencing tool of claim 1 wherein the fencing tool is painted either yellow, red, blue, green, pink or orange.

8. A fencing tool comprising:

a first end and a second end separated by a shaft, and a clip comprising a first end of the clip, wherein the first end, the shaft and the second end are coaxial;

wherein the diameter of the shaft and the outermost diameter of the second end are the same size;

wherein the outermost width of the first end has a larger size than the diameter of the shaft, wherein the outermost width is measured in a direction parallel to the diameter of the shaft;

wherein the second end further comprises:

a. an opening drilled through the second end and partially extending through the length of the shaft, wherein the opening is configured so that the first end of the clip fits within the opening and b. a plurality of grooves, wherein the plurality of grooves surround the exterior of only the second end, and the plurality of grooves extend the length of the second end, whereas said grooves are configured to provide a friction fitment against a fence.

9. The fencing tool of claim 8 wherein the shaft comprises an annular wall surrounding the opening and the opening has a diameter and wherein the thickness of the annular wall is greater than the diameter of the opening.

10. The fencing tool of claim 8 wherein the opening has a depth of at least 1.00 inch, but less than 3.00 inches.

11. The fencing tool of claim 9 where the opening has a depth of at least 1.00 inch, but less than 3.00 inches.

12. The fencing tool of claim 8 wherein the plurality of grooves extend at least 1.00 inch along the second end.

13. The fencing tool of claim 9 wherein the plurality of grooves extend at least 1.00 inch along the second end.

14. The fencing tool of claim 8 wherein the fencing tool is painted either yellow, red, blue, green, pink or orange.

15. A fencing tool comprising:

a first end and a second end separated by a shaft, wherein the first end, the shaft and the second end are coaxial;

wherein the diameter of the shaft and the outermost diameter of the second end are the same size;

wherein the outermost width of the first end has a larger size than the diameter of the shaft, wherein the outermost width is measured in a direction parallel to the diameter of the shaft;

the second end further comprising an opening drilled t through the second end and partially extending through the length of the shaft and wherein the shaft comprises an annular wall surrounding the opening and the opening has an opening diameter and wherein the thickness of the annular wall is greater than the opening diameter and wherein the second end further comprises an outer surface and a plurality of grooves only surrounding the outer surface of the second end, and the plurality of grooves extend the length of the second end to provide a friction fit as the user tightens the wire.

16. The fencing tool of claim 15 wherein the opening has a depth of at least 1.00 inch, but less than 3.00 inches.

17. The fencing tool of claim 16 wherein the plurality of grooves extend at least 1.00 inch along the second end.

18. The fencing tool of claim 17 wherein the fencing tool is painted either yellow, red, blue, green or orange.

* * * * *